US005941147A

United States Patent [19]

Naldi

[11] Patent Number: 5,941,147

[45] Date of Patent: Aug. 24, 1999

[54] PANEL CUTTING MACHINE

[75] Inventor: Valter Naldi, Bologna, Italy

[73] Assignee: Selco SPA, Via della Meccanica, Italy

[21] Appl. No.: 08/804,453

[22] Filed: Feb. 21, 1997

[30] Foreign Application Priority Data

Feb. 23, 1996 [IT] Italy ..... B096A0081

[51] Int. Cl.[6] ..... B26D 7/00

[52] U.S. Cl. ..... 83/102; 83/102.1; 83/167

[58] Field of Search ..... 83/102, 102.1, 83/105, 106, 147, 167

[56] References Cited

U.S. PATENT DOCUMENTS

| | | | |
|---|---|---|---|
| 3,310,080 | 3/1967 | Delcellier | 83/102 |
| 3,721,140 | 3/1973 | Campbell | 83/102 |
| 3,903,771 | 9/1975 | Fritz et al. | 83/102.1 |
| 4,108,032 | 8/1978 | Scheib et al. | 83/106 |
| 4,265,152 | 5/1981 | Corradi | 83/106 |
| 4,270,423 | 6/1981 | Angelo | 83/102.1 |
| 4,771,991 | 9/1988 | Sankaran | 83/105 |
| 5,488,887 | 2/1996 | Kitamura | 83/105 |

*Primary Examiner*—M. Rachuba

*Attorney, Agent, or Firm*—Lowe Hauptman Gopstein Gilman & Berner

[57] ABSTRACT

A machine for cutting wood panels, and having: a first worktable; a cutting station located along the first worktable and for cutting a first pack of panels along a first horizontal axis; a second worktable downstream from the first worktable and supplied with a second pack defined by a number of third packs of strips formed by cutting the first pack at the cutting station; and a cavity formed between the first worktable and the second worktable. The machine is mainly characterized by having at least one shuttle movable between an idle position outside the cavity, and a loading position wherein the shuttle is located inside the cavity to receive at least one fourth pack of strips formed by cutting the first pack at the cutting station.

11 Claims, 3 Drawing Sheets

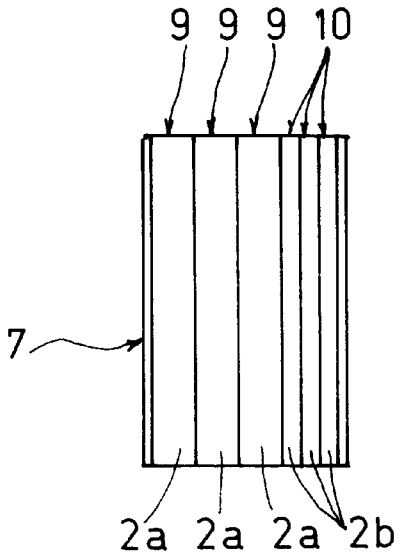
Fig.3
Fig.4
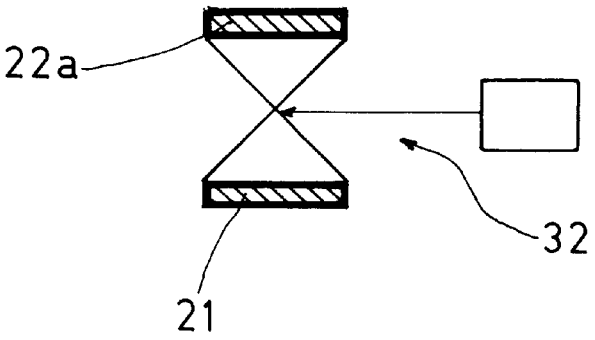

PANEL CUTTING MACHINE

BACKGROUND OF THE INVENTION

The present invention relates to a panel cutting machine, particularly for wood panels.

As is known, machines of the above type substantially comprise:

a vertically movable, horizontal platform for supporting a stack of panels;

a first worktable;

means for removing a pack of panels off the stack and transferring the pack onto the first worktable;

a first cutting station along the first worktable, for cutting the pack along a first horizontal axis;

means for pushing the pack on the first worktable to the first cutting station;

a second worktable downstream from the first, and to which the pack cut at the first cutting station is supplied;

a second cutting station along the second worktable, for cutting the pack along a second horizontal axis perpendicular to the first; and means for pushing the pack on the second worktable to the second cutting station.

In actual use, prior to cutting, the edge of the pack parallel to the cutting line is trimmed at the first cutting station, and the trimmings are pushed towards the second worktable to drop into a cavity defined between the two worktables. The cutting operation performed at the first station defines, for each panel, a number of strips, which may be either of the same or different widths.

The main drawback of the above machine is the difficulty in transferring thin, narrow strips from the first to the second worktable and along the second worktable to the second cutting station, owing to the obvious instability of packs of such strips, which tend to work loose during transfer.

What is more, in the event of one pack working loose, this causes a chain reaction, which also results in disarrangement of the packs of strips upstream and downstream, and misalignment of the packs supplied to the second cutting station, so that the machine must be turned off for the operator to realign the packs, with all the disadvantages this entails in terms of production time and cost.

SUMMARY OF THE INVENTION

It is an object of the present invention to provide a panel cutting machine designed to eliminate the aforementioned drawback.

According to the present invention, there is provided a machine for cutting wood panels, and comprising:

a first worktable;

a first cutting station located along said first worktable and for cutting a first pack of said panels along a first horizontal axis;

a second worktable downstream from said first worktable and supplied with a second pack defined by a number of third packs of strips formed by cutting said first pack at said first cutting station;

a cavity formed between said first worktable and said second worktable; and a conveyor for trimmings formed at said first cutting station; said conveyor collecting the trimmings inside said cavity, and conveying the trimmings to an unloading station outside said cavity;

characterized by comprising at least one shuttle movable between an idle position outside said cavity, and a loading position wherein, at a higher level than said conveyor, the shuttle is located inside said cavity to receive at least one fourth pack of strips formed by cutting said first pack at said first cutting station.

BRIEF DESCRIPTION OF THE DRAWINGS

A non-limiting embodiment of the present invention will be described by way of example with reference to the accompanying drawings, in which:

FIG. 3 shows a plan view of a pack of panels;

FIG. 4 shows a further embodiment of a member of the FIG. 1 machine.

DETAILED DESCRIPTION OF THE INVENTION

Figure 1:
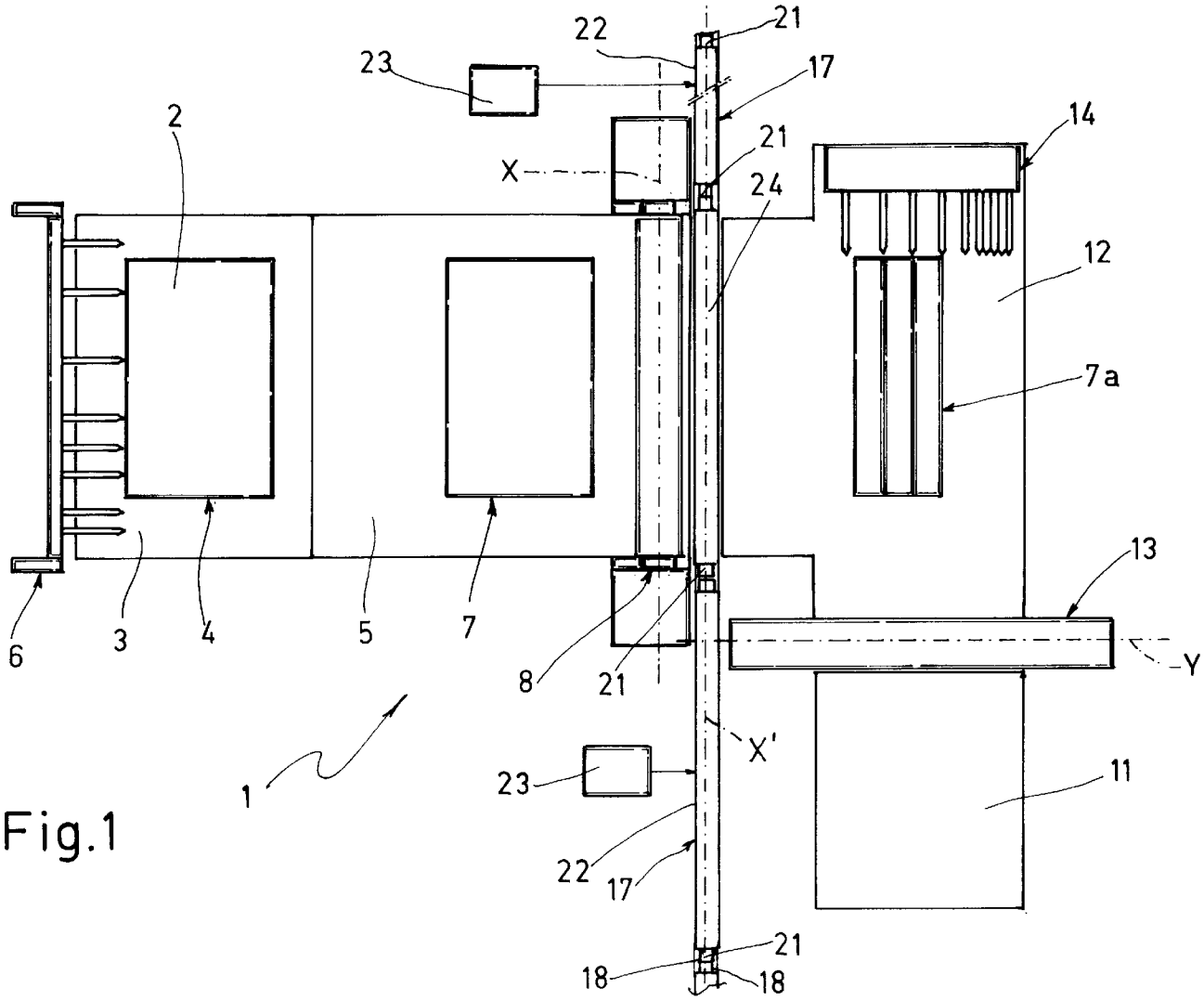
FIG. 1 shows a plan view of a panel cutting machine.

Number 1 in FIG. 1 indicates a machine for cutting wood panels 2, and comprising:

a vertically movable, horizontal platform 3 for supporting a stack 4 of panels 2;

a first worktable 5;

a first cutting station 8 located along first worktable 5, for cutting a pack 7 along a first horizontal axis X;

means 6 for removing pack 7 of panels 2 off stack 4 of panels 2 and transferring pack 7 onto first worktable 5 towards cutting station 8;

a second worktable 12 downstream from first worktable 5, on a level with worktable 5, and to which a pack 7*a* cut at first cutting station 8 is supplied;

a second cutting station 13 located along second worktable 12, for cutting pack 7*a* along a second horizontal axis Y perpendicular to first axis X;

means 14 for pushing pack 7*a* on second worktable 12 to second cutting station 13; and a third worktable 11 for receiving pack 7*a* from second cutting station 13.

In actual use, prior to cutting, the edge of pack 7 parallel to the cutting line defined by axis X is trimmed at first cutting station 8, and the trimmings are pushed towards second worktable 12 to drop into a cavity 15 defined between worktables 5 and 12, and having a horizontal longitudinal axis X' parallel to axis X. The cutting operation performed at first station 8 defines, for each panel 2, a number of strips, which may be either of the same or different widths.

As shown in FIG. 3, for example, first station 8 may form a number of strips 2*a* of a given width, and a number of narrower strips 2*b*, so that pack 7 is divided into a number of packs 9 of strips 2*a*, and a number of packs 10 of strips 2*b*.

Figure 2:
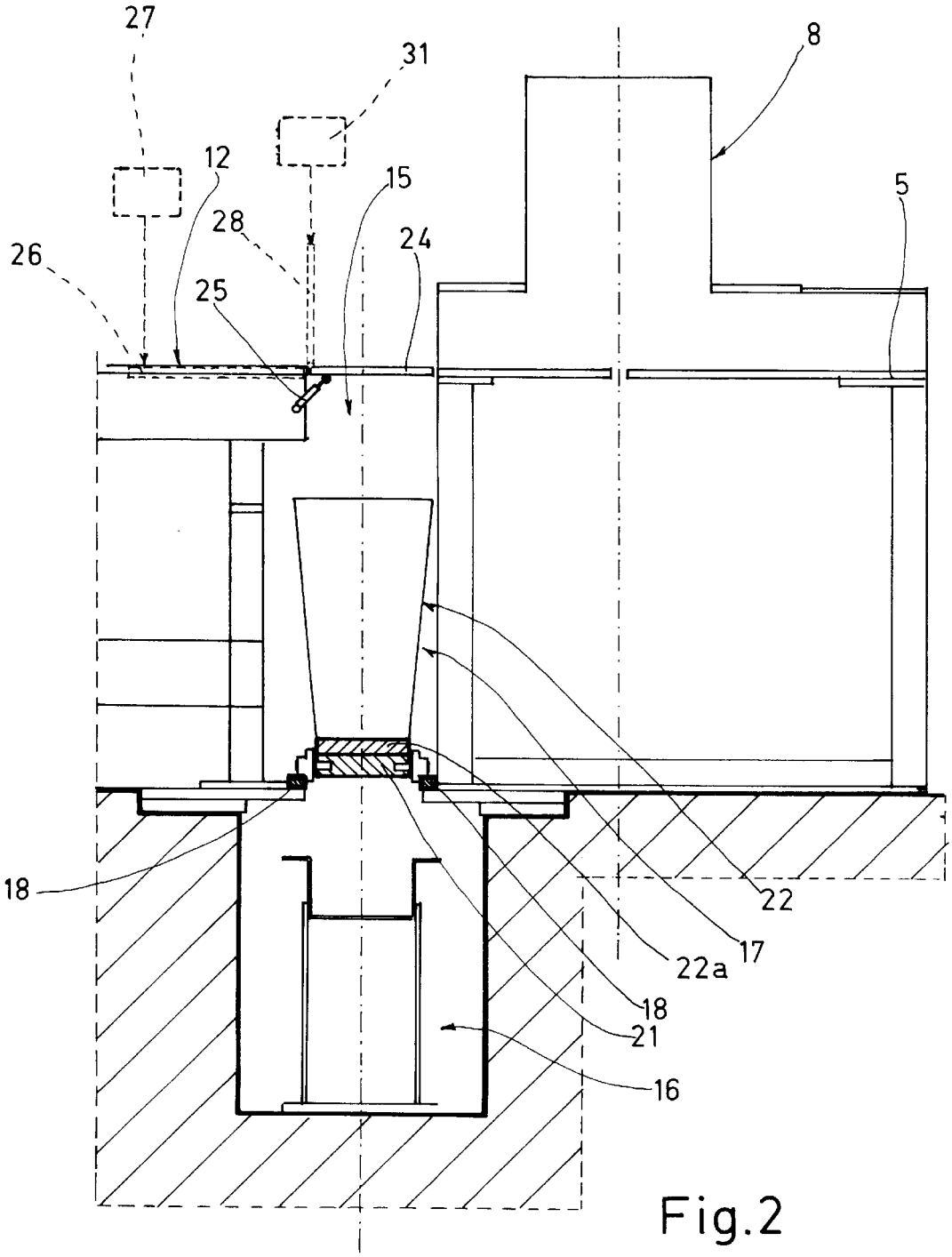
FIG. 2 shows a larger-scale section of part of the FIG. 1 machine.

With reference to FIGS. 1 and 2, cavity 15 houses a known device 16 for conveying the trimmings to an unloading station (not shown) outside cavity 15; and machine 1 comprises two shuttles 17, which, at a given operating stage, move into cavity 15 at a higher level than device 16 to receive one or more packs of strips, more specifically packs 10 of narrow strips 2*b*, while packs 9 of strips 2*a* form pack 7*a* for transfer onto worktable 12. Machine 1 also comprises two parallel horizontal rails 18 extending along cavity 15 along axis X'; and two opposite zones outside cavity 15, a first of which is relative to the idle position of a first shuttle 17, and a second to the idle position of a second shuttle 17.

Each shuttle 17 comprises a carriage 21 running along rails 18, and an open-topped hopper 22 supported on, and having a bottom wall 22*a* fitted to, carriage 21; and each shuttle 17 is moved back and forth, by drive means 23, between the idle position and a loading position wherein shuttle 17 is located inside cavity 15. When transferring packs 9 onto worktable 12 for supply to second cutting station 13, cavity 15 is closed by a flap 24 hinged to second worktable 12, and the upper surface of which is coplanar with the upper surface of worktable 12; and, when unloading one or more packs 10 into cavity 15, and hence into hopper 22, flap 24 is rotated into the open position by actuating means 25.

With reference to FIG. 2, in an alternative solution, flap 24 may be integral with a plate 26 (shown by the dotted line) located on worktable 12 and movable by actuating means 27 (shown by the dotted line) between two positions in which flap 24 respectively opens and closes cavity 15. In this solution, machine 1 comprises a vertical plate 28 (shown by the dotted line) which is moved vertically by actuating means 31 (shown by the dotted line) from a lowered position, in which it is located between plate 26 and flap 24 to act as a stop for packs 10 from cutting station 8, to a raised position enabling packs 9 from cutting station 8 to be fed onto worktable 12.

With reference to FIG. 4, according to a variation of the solution featuring flap 24 integral with plate 26, shuttle 17 may simply comprise wall 22*a*, and a member 32 for varying the vertical position of wall 22*a* with respect to carriage 21. More specifically, with plate 26 set to open cavity 15, and plate 28 in said stop position, wall 22*a* may first be raised flush with plate 26 to bridge worktables 5 and 12 and receive one or more packs 10, and may subsequently be lowered by an amount equal to the height of packs 10 deposited on wall 22*a*, so that further packs 10 are stacked, either immediately or at a subsequent cycle, on top of the packs 10 resting on wall 22*a*.

In actual use, when pack 7 of panels 2 is cut at first cutting station 8 into packs of strips of different widths, any packs not meant to form part of pack 7*a* for transfer to second cutting station 13—in that said packs either comprise narrow strips or do not require cutting at second cutting station 13—may advantageously be removed from pack 7 by simply moving shuttle 17 into said loading position, i.e. inside cavity 15, and opening cavity 15 so that the packs drop into or are deposited inside shuttle 17 as they are formed and pushed forward by the other packs formed at cutting station 8.

The loaded shuttle 17 is then moved into the idle position where the removed packs are unloaded. If any more packs are to be removed in the meantime, the other shuttle 17 is moved into cavity 15 to receive another load; conversely, cavity 15 is closed to enable the packs coming from first cutting station 8 to be transferred to second cutting station 13.

The advantages of the present invention will be clear from the foregoing description.

In particular, the machine comprises shuttles for removing from the pack of panels formed at the first cutting station any packs of strips not meant for transfer to the second cutting station; which removal system is especially useful for removing from the pack formed at the first cutting station any packs of narrow strips, which, as stated, create problems by becoming disarranged as they are transferred along the second worktable. Moreover, the removal system described is straightforward to produce by exploiting an existing cavity used on known machines for trimming disposal.

Clearly, changes may be made to machine 1 as described and illustrated herein without, however, departing from the scope of the present invention.

In particular, the removal system described above may also be installed at cutting station 13 between worktables 11 and 12.

I claim:

1. A machine for cutting wood panels, and comprising:

a first worktable;

a first cutting station located along said first worktable and for cutting a first pack of said panels along a first horizontal axis (X);

a second worktable downstream from said first worktable and supplied with a second pack defined by a number of third packs of strips formed by cutting said first pack at said first cutting station;

a cavity formed between said first worktable and said second worktable;

a conveyor for trimmings formed at said first cutting station; said conveyor collecting the trimmings inside said cavity, and conveying the trimmings to an unloading station outside said cavity; and a shuttle movable between an idle position outside said cavity, and a loading position wherein, at a higher level than said conveyor, the shuttle is located inside said cavity to receive at least one fourth pack of strips formed by cutting said first pack at said first cutting station, wherein said shuttle is positioned above said conveyor.

2. A machine as claimed in claim 1, characterized by comprising a flap, and actuating means for moving said flap between a position wherein said flap closes said cavity, and a position wherein said flap opens said cavity.

3. A machine as claimed in claim 2, characterized by comprising a vertical plate movable vertically, by actuating means, from a lowered position wherein said plate acts as a stop for said fourth packs from said first cutting station, to a raised position permitting said third packs from said first cutting station to be fed onto said second worktable.

4. A machine as claimed in claim 1, characterized by comprising two rails for moving said shuttle between said idle position and said loading position.

5. A machine as claimed in claim 1, characterized in that said shuttle comprises a hopper open at the top and having a bottom wall on which said fourth pack rests in said loading position.

6. A machine as claimed in claim 1, characterized in that said shuttle comprises a wall on which said fourth pack rests in said loading position.

7. A machine as claimed in claim 6, characterized by comprising a carriage for supporting said shuttle and which is run, by drive means, along said rails.

8. A machine as claimed in claim 7, characterized by comprising a member for varying the vertical position of said wall with respect to said carriage, so that said wall may be raised flush with said second worktable to receive one or more of said fourth packs, and said wall may be lowered gradually, so that, immediately or at a subsequent cycle, further said fourth packs may be stacked on top of said fourth packs already deposited on said wall.

9. A machine as claimed in claim 1, characterized by comprising a second cutting station located along said second worktable and for cutting said second pack along a second horizontal axis (Y) perpendicular to said first horizontal axis (X).

10. A machine for cutting wood panels, and comprising:

a first worktable;

a first cutting station located along said first worktable and for cutting a first pack of said panels along a first horizontal axis (X);

a second worktable downstream from said first worktable and supplied with a second pack defined by a number of third packs of strips formed by cutting said first pack at said first cutting station;

a cavity formed between said first worktable and said second worktable;

a conveyor for trimmings formed at said first cutting station; said conveyor collecting the trimmings inside said cavity, and conveying the trimmings to an unloading station outside said cavity; and a shuttle over said conveyor, said shuttle movable between an idle position outside said cavity, and a loading position wherein, at a higher level than said conveyor, the shuttle is located inside said cavity to receive at least one fourth pack of strips formed by cutting said first pack at said first cutting station.

11. A machine as claimed in claim 10, wherein said shuttle comprises a hopper open at the top and having a bottom wall on which said fourth pack rests in said loading position.

* * * * *